US006922856B2

(12) United States Patent
Mazar

(10) Patent No.: US 6,922,856 B2
(45) Date of Patent: Aug. 2, 2005

(54) SAFETY BATHTUB

(76) Inventor: Ofir Mazar, 12 Kaplinski Street, Rishon LeZion 75241 (IL)

( * ) Notice: Subject to any disclaimer, the term of this patent is extended or adjusted under 35 U.S.C. 154(b) by 97 days.

(21) Appl. No.: 10/672,568

(22) Filed: Sep. 26, 2003

(65) Prior Publication Data

US 2005/0066436 A1 Mar. 31, 2005

(51) Int. Cl.[7] ..... A47K 3/02
(52) U.S. Cl. ..... 4/538; 4/545
(58) Field of Search ..... 4/538, 493, 545, 4/572.1, 659, 598

(56) References Cited

U.S. PATENT DOCUMENTS

| | | | | |
|---|---|---|---|---|
| 3,864,976 A | | 2/1975 | Parker | |
| 3,965,742 A | * | 6/1976 | Parker | 374/161 |
| 5,282,683 A | | 2/1994 | Brett | |
| 5,487,393 A | * | 1/1996 | Haswell et al. | 600/573 |
| 6,105,618 A | * | 8/2000 | Blaney | 138/89 |
| 6,578,209 B2 | * | 6/2003 | Lopes et al. | 4/572.1 |
| 6,618,867 B2 | * | 9/2003 | Hodak | 4/496 |

FOREIGN PATENT DOCUMENTS

| | | | |
|---|---|---|---|
| DE | 29900165 U1 | * | 9/1999 |
| GB | 2108838 A | * | 5/1983 |
| JP | 08000488 A | * | 1/1996 |

* cited by examiner

*Primary Examiner*—Khoa D. Huynh
(74) *Attorney, Agent, or Firm*—Robert L. Stone

(57) ABSTRACT

A safety bathtub including at least one upstanding wall; and a built-in thermometer in the wall, the thermometer including a measuring portion and a scale portion, and the thermometer being mounted such that the measuring portion is immersed in water when the bathtub has water in it, and the scale portion is out of the water when the bathtub has water in it, for continual monitoring from outside and above the bathtub.

11 Claims, 3 Drawing Sheets

SAFETY BATHTUB

FIELD OF THE INVENTION

The present invention relates to bathtubs in general, and in particular, to a safety bathtub, especially for babies.

BACKGROUND OF THE INVENTION

Bathtubs of many shapes and sizes have long been known. When bathing babies and children, safety considerations are particularly important, especially the temperature of the bath water. If the bath water is too hot, the child will be burnt, while if the water is too cold, the child runs the risk of catching cold. In any event, trauma to the baby due to incorrect temperature is undesirable. Similarly, the elderly and other adults must take care with regard to the water temperature in the bath.

In the past, the temperature of the water has generally been measured before putting the child into the bathtub. The most common method is that of inserting an elbow into the water, or dripping the water on a wrist, in order to determine whether it is too hot or cold. In addition, a number of thermometers have been designed for measuring the temperature of the bath water. These generally include a separate, floating thermometer which is placed in the tub and which must be removed to read the temperature. When monitoring the temperature of the water before and during bathing, the thermometer is read, then returned to the water, removed a few minutes later for an additional reading, and returned to the water. This frequent immersion and removal leads to inaccurate readings on conventional thermometers.

Another important fact about floating thermometers is that they are influenced (as is the upper level of the water) by the outside temperature, and therefore provide an inaccurate measurement. That deviation cannot be adjusted, because the outside temperature is constantly changing.

There is also shown in U.S. Pat. No. 5,375,271 a separate bath mat having temperature related indicia. This device indicates dangerous temperature ranges, i.e., above or below pre-determined threshold limits. However, it is limited in that it does not indicate the exact temperature, and it is not visible for monitoring when the water becomes cloudy, as a result of shampoo, soap, bath oil, etc.

In addition, care must be taken that a baby does not become entangled in the thermometer cord or scratch himself on the thermometer housing. Furthermore, these thermometers cannot be seen when soap bubbles are on the water in the tub or when the water is unclear due to a mixture of soap or bath oil in the bath water.

With regard to the current methods available today, and as mentioned before, floating thermometers do not measure accurately, because they are influenced by the outside temperature. Another option, available today, is to use a non-floating thermometer, which is also limited because, when placed in the water, it will sink, and will not permit continuous monitoring.

There are also known heating elements with thermostats in Jacuzzi bathtubs for monitoring and automatically controlling the temperature in the Jacuzzi. These thermostats are complicated, expensive to install and maintain, and include electrical parts.

Accordingly, there is a long felt need for a device for permitting continual monitoring of the water temperature in a bathtub, and it would be very desirable to have such a device which is not free floating in the tub and, therefore, poses no safety hazard in itself. The unique method of the present invention including the safety bathtub, provides an another important characteristic which was not available before: it provides accurate measuring, while allowing continuous monitoring, at the same time.

SUMMARY OF THE INVENTION

According to the present invention, there is provided a safety bathtub including at least one upstanding wall, and a built-in thermometer mounted in the wall, where the thermometer is mounted such that a measuring portion is immersed in water when the tub has water in it, and a scale portion is out of the water for continual monitoring.

According to a preferred embodiment, the thermometer is mounted flush with the wall.

According to one embodiment of the invention, the thermometer is mounted in a recess pre-formed in the wall of the bathtub.

According to a preferred embodiment, the thermometer is releasably snap-fit into the recess.

There is also provided in accordance with the present invention a method of forming a safety bathtub including the steps of mounting a thermometer, including a temperature measuring portion and a scale portion, in a wall of a bathtub, to form a built-in thermometer, arranging the temperature measuring portion beneath a recommended water level line, and at least a portion of the scale portion above the recommended water level line, to permit continuous monitoring, from outside and above the bathtub, of the temperature in the bathtub beneath the water level line.

BRIEF DESCRIPTION OF THE DRAWINGS

The present invention will be further understood and appreciated from the following detailed description taken in conjunction with the drawings in which.

DETAILED DESCRIPTION OF THE INVENTION

The present invention relates to a safety bathtub, particularly for use by babies and small children, although also suitable for the elderly and other adults. The bathtub includes a built-in thermometer, preferably flush with a wall of the bathtub, to permit continuous monitoring, from outside the bathtub, of the temperature of the water in the tub before and after bathing, especially by a person outside the tub who is bathing a baby or other individual inside the tub.

Figure 1A:
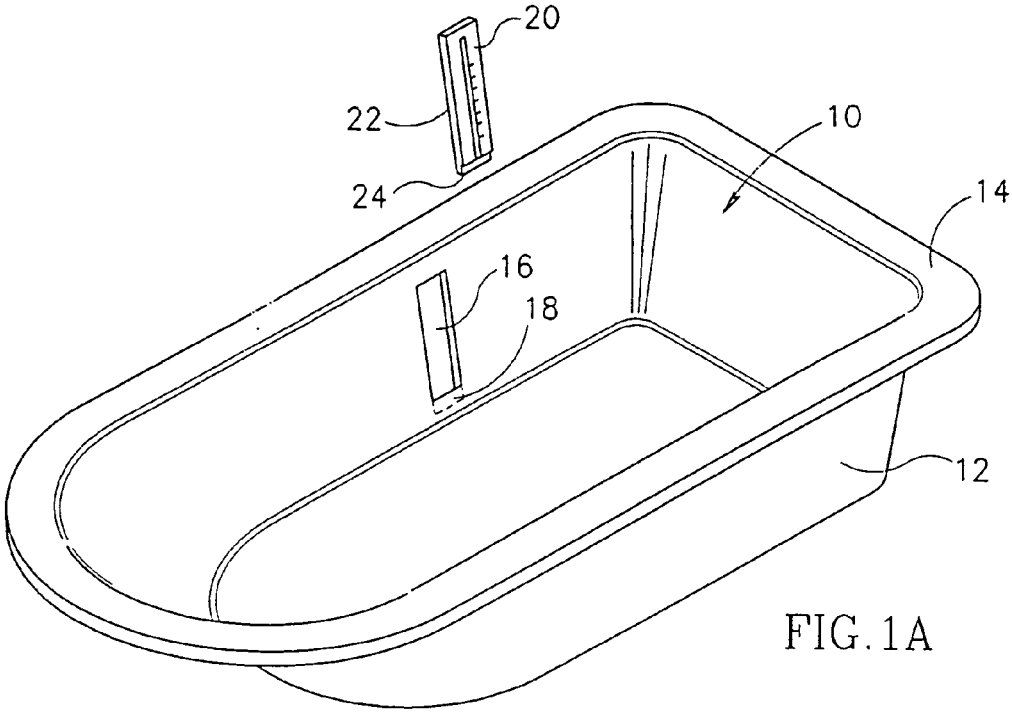
FIG. 1*a* is an exploded perspective view of a safety bathtub constructed and operative in accordance with one embodiment of the present invention.
Figure 1B:
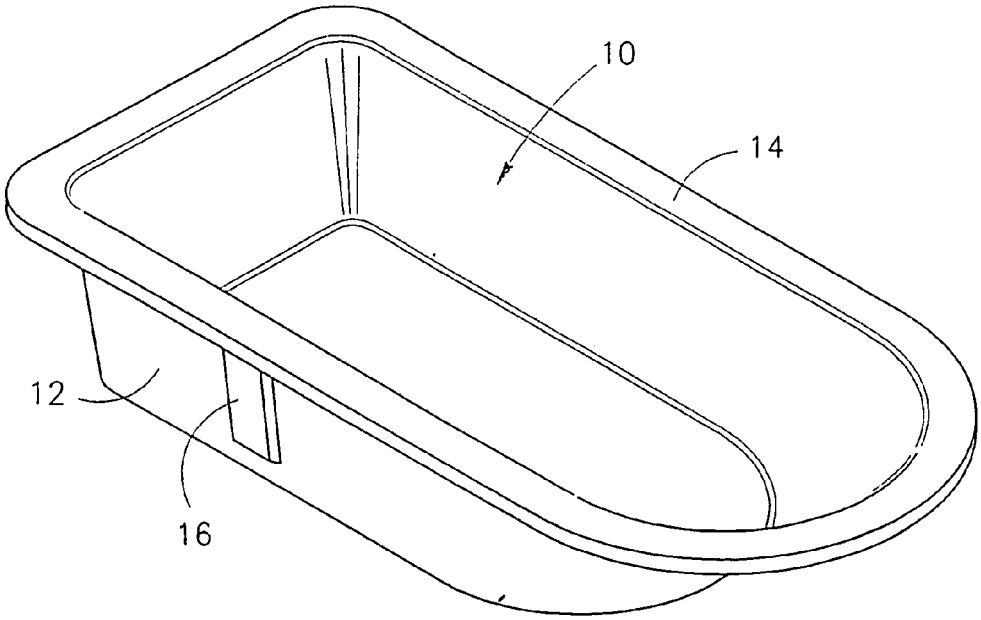
FIG. 1*b* is an outside perspective view of the safety bathtub of FIG. 1*a;*

Referring now to FIGS. 1*a* and 1*b*, there are shown respective expanded inside and outside perspective views of one embodiment of the safety bathtub of the present invention. The tub of FIGS. 1*a* and 1*b* includes a tub shell 10 having an upstanding wall 12 and a lip 14 around the upper edge of wall 12. Shell 10 can be of any desired shape, and is illustrated here as a truncated ellipse. Shell 10 is preferably formed of cast plastic or Fiberglas, although it can alternatively be formed of any other suitable material.

According to this embodiment of the invention, the tub shell 10 includes a pre-formed recess 16. Preferably, recess 16 includes a pocket 18 (shown in broken lines) at the bottom. A thermometer 20, which can be any conventional thermometer, is arranged for mounting in recess 16. In the illustrated embodiment, thermometer 20 includes a frame 22 with a thinner lower portion 24. Thinner portion 24 is arranged to seat in pocket 18 of recess 16, thereby preventing thermometer 20 from falling out of recess 16. According to one embodiment of the invention, the recess is transparent, so the temperature can be read from outside the bathtub.

A strip of double-sided adhesive (not shown) or other adhesive material can be provided at the top of the thermometer frame to help affix the thermometer in recess 16. Alternatively, thermometer 20 can be mounted by friction in recess 16, or permanently affixed therein, as by screws or any other method. According to another embodiment, pre-formed clips are provided on the bathtub for mounting the thermometer with a measuring portion beneath the recommended water level line, and a scale portion above the recommended water level line.

It is a particular feature of this embodiment of the present invention that the thermometer is flush with the wall of the tub. In this way, a baby in the tub will not be scratched by a protruding frame.

Figure 2:
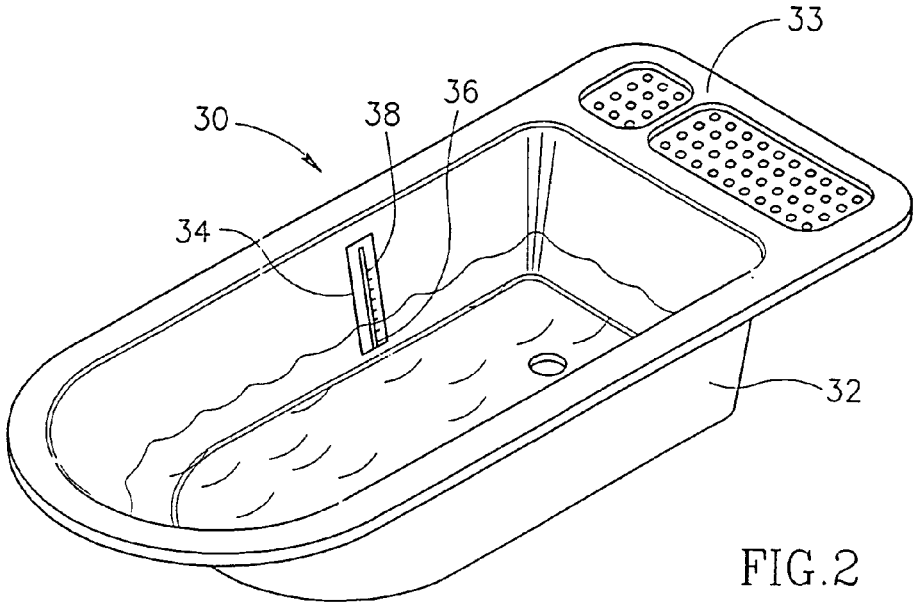
FIG. 2 is a perspective view of one embodiment of the safety bathtub of the present invention is use.

Referring now to FIG. 2, there is shown a perspective view of the safety bathtub 30 of one embodiment of the present invention in use. As can be seen, shell 32 of bathtub 30 includes a built-in thermometer 34 in its wall. Thermometer 34 is located such that the temperature measuring portion 36 is located in the water, when the tub has water in it, while a scale portion 38 extends above the water level. Preferably, the thermometer is located in such a way that the scale above about 20° C. is above a recommended water line. In any event, it will be appreciated that the scale can be viewed even when the tub has water, soap bubbles, and toys inside, as well as when the water is cloudy due to the mix of soap, shampoo, bath oil or dirt, and water in the tub.

In the illustrated embodiment, bathtub 30 includes an integral shelf 3 extending from one end or side thereof, on which soap, shampoo, and other necessary bath items can be placed during the bath.

Figure 3:
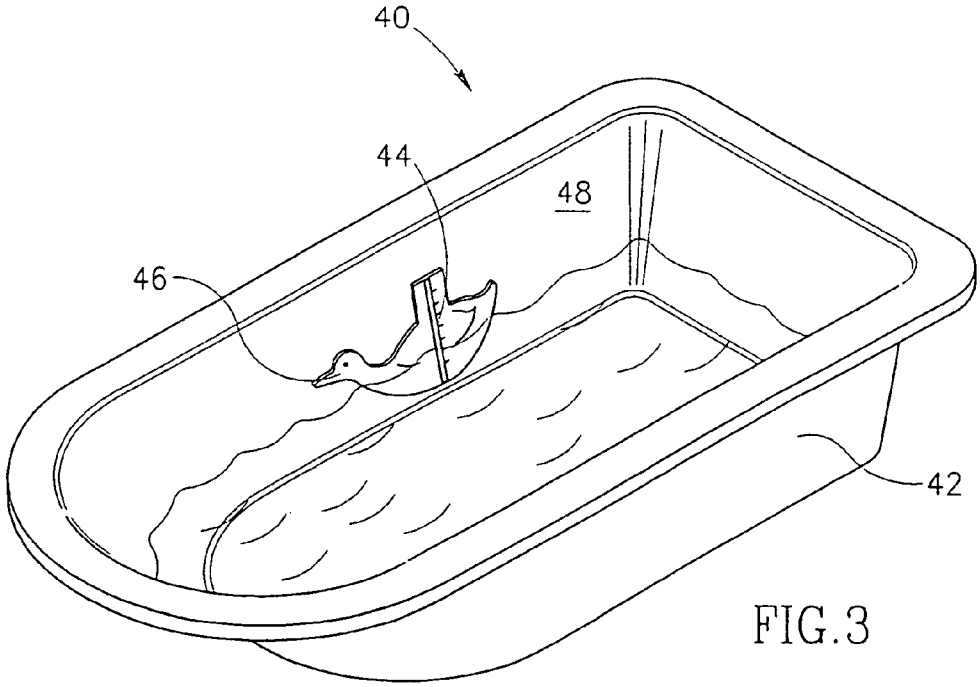
FIG. 3 is a perspective view of another embodiment of the safety bathtub of the present invention is use.

With reference to FIG. 3, there is shown a perspective view of a safety bathtub 40 constructed and operative in accordance with another embodiment of the present invention. Bathtub 40 includes a shell 42 and a built-in thermometer 44 mounted in a decorative frame 46. In this way, the frame serves to decorate the tub, and can include any favorite shape, such as a duck, as shown, or a cartoon character. While it is preferred that frame 46 be flush with the wall 48 of the tub, alternatively it can extend slightly into the tub, giving the illusion of being three dimensional.

Figure 4:
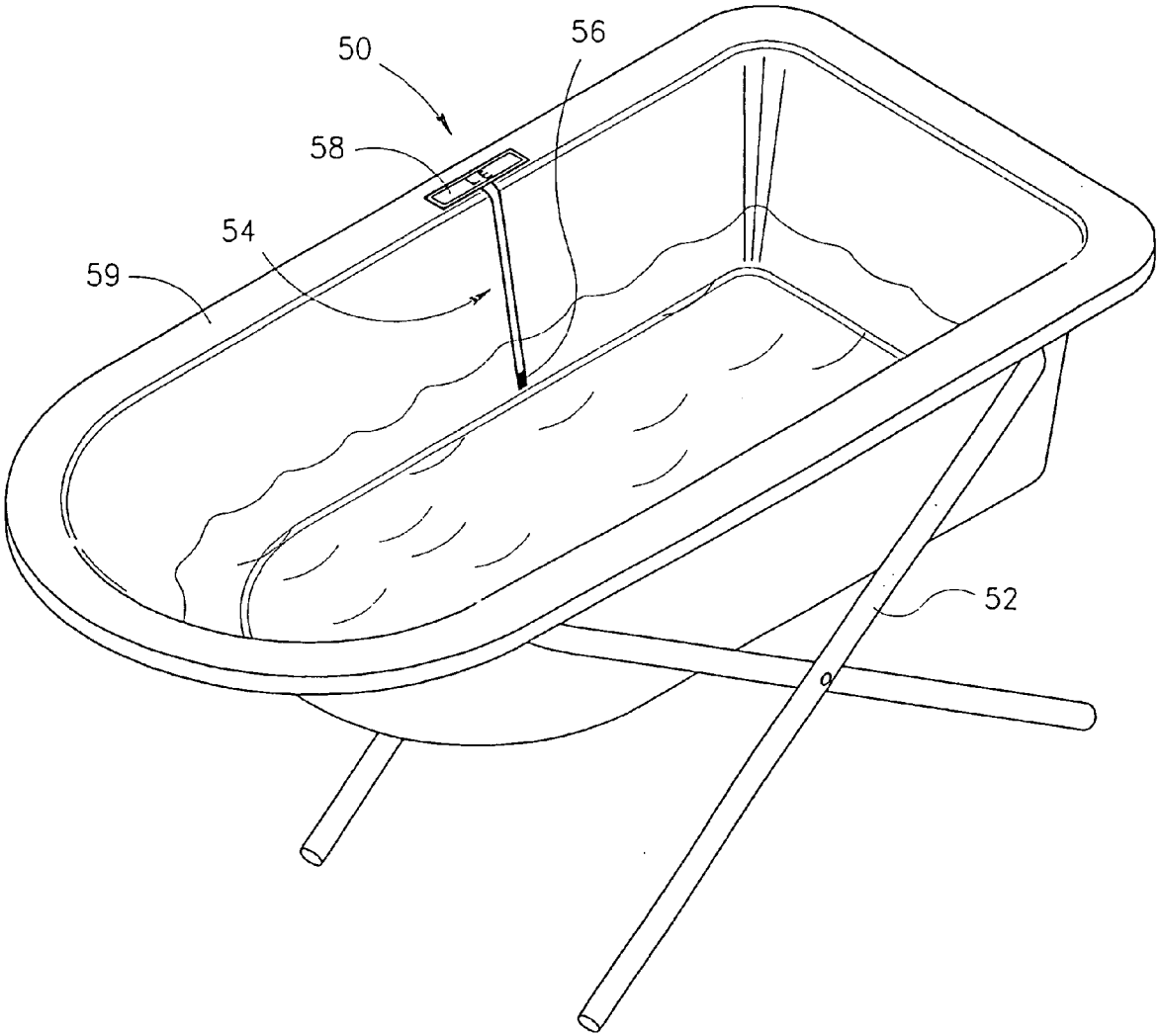
FIG. 4 is a perspective view of yet another embodiment of the safety bathtub of the present invention is use.

FIG. 4 is a perspective illustration of a safety bathtub 50 constructed and operative in accordance with yet another embodiment of the invention. Bathtub 50 may be a baby's tub, as illustrated seated on legs 52, a full size tub, or a half-size tub, a portable tub, or fixed in place, all as known. Bathtub 50 includes a built-in thermometer 54, which is a digital thermometer. It is illustrated herein as being an angular thermometer, a thermometer bent so that its temperature measuring portion 56 extends from below the water level up the wall of the tub, while the scale portion 58 seats in the lip 59 of bathtub 50. In this way, the temperature can be read easily and continuously from above and outside the tub.

Thermometer 54 preferably is seated in a pre-formed recess formed with the shell of the tub. Alternatively, an appropriately shaped groove or recess can be formed in an existing bathtub, for inserting the thermometer.

Operation of the safety bathtub of the present invention is as follows. The bathtub is formed with the built-in thermometer in the wall. Any conventional thermometer can be utilized, so the bathtub can be easily and inexpensively manufactured and maintained. The thermometer can be releasably mounted in the wall, for replacement in case of need, or can be permanently affixed in the wall.

Needless to say that the thermometer in the present invention will be a suitable thermometer for use in water, and it preferably will be pre-formed properly to measure the water temperature from its specific location, without any abnormal deviation.

When it is time to bathe a baby or other individual, the tub is filled with water to a recommended water line. As the water fills the tub, the measuring portion of the thermometer, which is under the water level line, indicates the temperature of the water, so that it can be adjusted, as required. When the tub has been filled to the desired depth, and the temperature is in the desired range, the baby in placed in the water. The baby can now be bathed in the normal manner, and the temperature can be monitored at any time during the bath, merely by glancing, from outside and above the bathtub, at the scale on the thermometer, which remains above the water line. Even if the bath water clouds with soap, oil, and/or dirt, the scale can still be read at all times, without requiring the bather to pick up the thermometer with his hands, and without affecting the thermometer readings by repeated immersions in the water. Thus, the bather can obtain accurate temperature readings at all times before and during bathing.

It will be appreciated that the invention is not limited to what has been described hereinabove merely by way of example. Rather, the invention is limited solely by the claims which follow.

What is claimed is:

1. A safety bathtub comprising:

a tub having a bottom, an upstanding wall integrally formed with and extending from the bottom, and an integrally pre-formed thermometer-receiving recess in said upstanding wall of said tub;

said recess being formed with a portion below a water level line and a portion above said water level line; and a built-in mounted thermometer in said recess, said thermometer including a measuring portion and a scale portion, and said thermometer being mounted such that said measuring portion is immersed in water when the bathtub has water in it regardless of said water level line, and said scale portion is mounted out of the water when the bathtub has water in it regardless of said water level line, for continual temperature monitoring during use by a person outside and above the bathtub.

2. The safety bathtub according to claim 1, wherein said thermometer is releasably mounted by friction in said recess.

3. The safety bathtub according to claim 1, wherein said thermometer is permanently mounted in said recess.

4. The safety bathtub according to claim 1, wherein said thermometer is a digital thermometer.

5. The safety bathtub according to claim 1, wherein said thermometer is bent at an angle such that said measuring portion is beneath said water level line while said scale portion faces upwards on a top lip of said tub.

6. The safety bathtub according to claim 1, wherein said thermometer is seated within said recess flush with said wall, so as not to protrude or extend into the bathtub.

7. The safety bathtub according to claim 1, wherein said bathtub is a portable baby's bathtub formed of plastic.

8. The safety bathtub according to claim 7, wherein said thermometer is seated within said recess flush with said wall, so as not to protrude or extend into the bathtub.

9. A method of forming a safety bathtub comprising the steps of:

forming a tub having a bottom, an upstanding wall integrally formed with and extending from the bottom, and an integrally pre-formed thermometer-receiving recess in said upstanding wall of said tub;

said recess being formed with a portion below a water level line and a portion above said water level line; and mounting a thermometer, including a temperature measuring portion and a scale portion, in said recess, to form a built-in mounted thermometer, such that said temperature measuring portion is immersed in water when the bathtub has water in it regardless of said water level line, and said scale portion is mounted out of the water when the bathtub has water in it regardless of said water level line, to permit continuous monitoring of the temperature during use in said bathtub beneath said water level line by a person outside and above the bathtub.

10. The method according to claim 9, wherein said step of mounting includes seating said thermometer within said recess flush with said wall, so as not to protrude or extend into the bathtub.

11. The method according to claim 9, wherein said step of forming includes forming said tub with said recess integrally pre-formed partially in said upstanding wall of said tub and extending into a top lip of said tub and further including providing said thermometer bent at an angle and seating said bent thermometer in said recess such that said measuring portion is mounted in said upstanding wall while said scale portions faces upwards on said top lip.

* * * * *